United States Patent [19]

Miller

[11] Patent Number: 4,489,314

[45] Date of Patent: Dec. 18, 1984

[54] GOLF CLUB MONITOR

[76] Inventor: Sheldon M. Miller, 4636 S. Wheeling, Tulsa, Okla. 74105

[21] Appl. No.: 422,269

[22] Filed: Sep. 23, 1982

[51] Int. Cl.[3] ..... G08B 13/14; G08B 23/00; A63B 55/00

[52] U.S. Cl. ..... 340/568; 273/32 E; 200/61.41; 206/315.3; 340/323 R

[58] Field of Search ..... 273/32 E; 340/64, 323 R, 340/568; 200/61.41, 61.59; 206/315.3, 315.6

[56] References Cited

U.S. PATENT DOCUMENTS

| | | | |
|---|---|---|---|
| 3,473,110 | 10/1969 | Hardin | 340/568 |
| 4,042,918 | 8/1977 | Klitzman | 340/568 |
| 4,291,296 | 9/1981 | Seifers | 340/64 |

*Primary Examiner*—James J. Groody

*Attorney, Agent, or Firm*—Head, Johnson & Stevenson

[57] ABSTRACT

A system associated with, and attached to, a golf club bag, for monitoring the presence or absence of at least certain ones of the golf clubs carried in a golf bag. This comprises an assembly of a plurality of laterally spaced long tubular parallel receptacles each one adapted to receive the shaft of a golf club. The assembly is adapted to be inserted into and supported by the open top of the golf bag. Sensors means are associated with each of the tubular receptacles for determining when the shaft of a golf club is inserted into the receptacle. Electronic detectors are provided for monitoring the action of each of these sensors so that an immediate indication can be given, by activating an alarm of selected type when any of the clubs are not in position in their selected tubular receptacle.

26 Claims, 6 Drawing Figures

GOLF CLUB MONITOR

BACKGROUND OF THE INVENTION

1. Field of the Invention

This invention lies in the field of the monitoring of many different kinds of articles such as tools, art objects, coins, golf equipment, etc., for convenience and without limitation the invention will be described in terms of apparatus to be used in conjunction with a golf club bag, and a selected plurality of golf clubs, so that electronic circuits can monitor the presence or absence of a golf club from any one of the selected receptacles into which the clubs are inserted inside of the bag. The purpose of this invention is to inform the player as he moves from hole to hole along the golf course, that he has placed each of the clubs in their proper receptacle and that none are missing from the plurality of selected receptacles into which they would normally be inserted.

2. Description of the Prior Art

In the prior art there are a number of different ways taught for monitoring the presence or absence of golf clubs from a golf bag. Of course, one of the simplest is just to visually monitor the presence of a club shaft in each of a selected group of openings in a cover plate over the top of the golf bag. Unfortunately, the heads of the clubs are much larger than the shafts and therefore, can often make it difficult for the player to rapidly visually monitor the golf bag. Consequently, it appears that a sensor of some sort is required, associated with each of the openings through which the golf club shaft is inserted into the bag. Thus, each one of the selected clubs can be continuously monitored as to their presence or absence from the bag.

Of course, each player has his own way of handling his clubs and his bag, and he may not be satisfied with a simple on-off switch associated with each of the receptacles into which the shaft of the clubs are inserted and providing an alarm which sounds whenever one or more of the clubs are withdrawn from the bag and the sensors do not sense a corresponding club shaft in their vicinity. Therefore, it becomes desirable to provide a suitable logic mechanism so that the player can, in effect, program his monitoring system so that it will operate in a selected way under selected conditions and vice versa. The present invention is adapted to provide this type of operation.

SUMMARY OF THE INVENTION

The problem of monitoring the presence or absence of a selected club from the bag is simplest when the bag is carried by the player since the bag is carried right to the point at which the club is used and if each club is replaced in the bag immediately after each use, there will not be a likelihood of the club being left in the field, on the fairway or in the rough. On the other hand, when the bag is carried in a cart with one or more other bags, the bag is not always close to the player and in order to be sure he will have the club that he really needs, he may pick two or more from the bag and walk over to the ball, then select one of those two or more and use it. The cart is now some distance from the player, perhaps closer to where the second player is, and therefore the first player must remember to pick up the second and third clubs before he leaves that spot. It very often happens that he does not remember until much later, after he has moved on to another hole and then he can't quite remember where he lost, left or forgot the clubs.

With this monitoring apparatus in the golf bag, it insures that at least after each hole is completed and the putter is put back in the bag all other clubs should also be in the bag and the monitor will then provide an alarm under selected conditions if everything is not as it should be. The putter has special significance since it is the last club used on each hole, and can be used to control the logic.

There are many ways in which the player may operate and control his monitor system. For example, he can have the alarm sound as soon as one club is removed from the bag. Of course, this sets the alarm and it remains set until the club is put back in the bag. On the other hand, it can be set up so that when the first club is removed from the bag no alarm will be sounded until the putter has been removed and replaced and the act of replacing the putter, indicating that the hole has been completed, provides the opportunity of checking or monitoring the bag before leaving the location of that specific hole.

It is a primary object of this invention to provide a monitoring system for keeping track of at least a selected group of the clubs which are normally carried in the golf bag.

It is a further object of this invention to provide means, not only to monitor the presence or absence of a club from the bag, but to so control the alarm that it is most effective in the sense that it is not utilized or not activated unless a certain group of circumstances arise. Then it can be activated to make a positive impression on the player that it needs his attention to the situation in the bag.

It is still a further object of this invention to provide a microprocessor unit which can be programmed in order to operate in a way selected by the individual player, so that it is most convenient for him to activate the alarm under conditions which he alone can provide.

These and other objects are realized and the limitations of the prior art are overcome in this invention by providing an assembly which is fitted to, and can be inserted into a golf bag, and be supported by the open top of the bag. In the top surface of the assembly are a plurality of circular openings each one of which leads to a long tubular receptacle dependent from the cover plate, and inside of the bag. Each of the clubs is normally carried in a selected one of the receptacles.

Associated with each receptacle is a sensor of one sort or another. One embodiment can be a pair of electrical contacts, at least one of which is spring controlled, which can contact the metal shaft of the club in order to close the appropriate electrical circuit. Then, with suitable logic, the groups of contacts associated with the plurality of openings and golf clubs will provide the type of response which is desired.

The preferred method is to provide an electromagnetic sensor associated with each of the receptacles and connected into an electronic circuit. The coil is powered through a series resistor from an electrical oscillator of selected frequency and may, if desired, be at least partially tuned to oscillate at the frequency of the oscillator. This will provide either a low impedance or a high impedance. Dependent on what electrical impedance is effected by the insertion of the club shaft into the coil, appropriate voltages are provided, associated with the induction coil, and it is these voltages which are monitored and controlled by the microprocessor in order to provide and activate the appropriate alarm under the appropriate conditions.

I have observed that in many instances when clubs are lost, they will be one or more of the irons rather than the woods. The reason is that when teeing off, the woods are used, the golf bag is close by and the club is replaced promptly.

The electrical conductivity for switching the metallic surface of the metal shafts is advantageous. However, there is a tendency for dirt and grime to coat the contact so that under certain adverse conditions, there may be a failure to detect the presence of a club in the receptacle, unless the club shafts are kept clean.

If some of the clubs are less likely to be forgotten and left on the field and lost, it is possible to use a blank receptacle, without a sensor for each of those clubs which minimizes the amount of electronic apparatus which is required and the cost. However, the incremental cost of leaving out one or more sensors may not be worth the difficulty of maintaining spare parts and various types of models which would be needed under each of these conditions.

BRIEF DESCRIPTION OF THE DRAWINGS

These and other objects and advantages of this invention and a better understanding of the principles and details of the invention will be evident from the following description taken on conjunction with the appended drawings in which.

DESCRIPTION OF THE PREFERRED EMBODIMENTS

Figure 1:
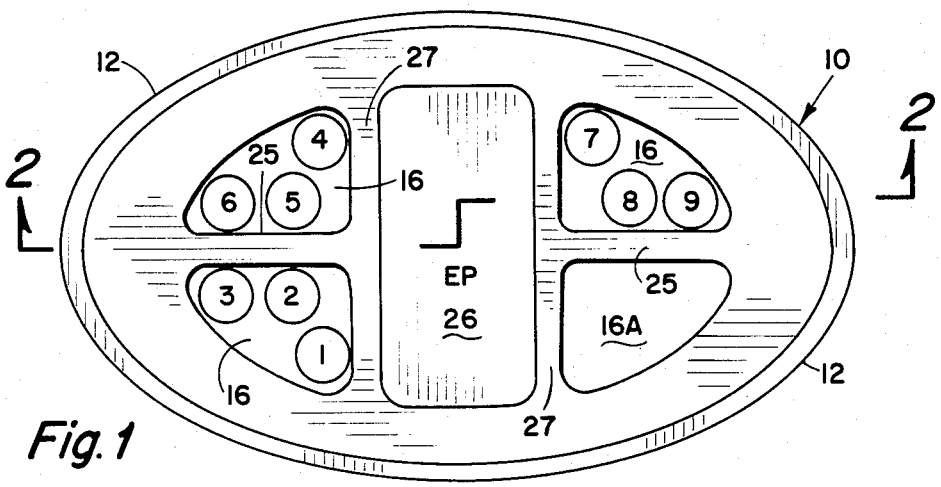
FIGS. 1 and 2 show schematically plan and vertical section of one embodiment of this invention.
Figure 2:
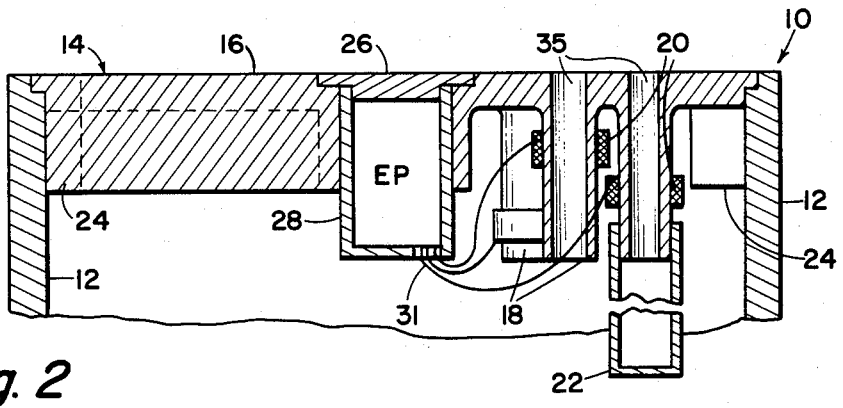

Referring now to the drawings and in particular to FIGS. 1 and 2, there is shown in plan view, one embodiment of the invention, and a vertical section taken along the plane 2—2 of FIG. 1. The monitoring system is indicated generally by the numeral 10 and comprises an assembly, including a top plate 16 in the shape of an oval, or a circle, as desired, such as to fit into and be retained, or removed from the top band 12 of a golf bag. Of course, the assembly can be made removable or can be molded intact, for example, with the top of the bag. However, in most cases, it will be convenient to have it mounted inside and removable therefrom, without too much difficulty. There will be a box 28 with cover 26 for holding all the electronic components and power supply that will be needed. Thus the assembly 10 will be useful any place, irrespective of where power might be available. On the other hand, if it is desired to utilize this monitoring system only when the bags are carried in a golf cart, then the electronics can of course be powered from the battery of the golf cart.

A selected arrangement of tubular openings 35 are provided. Each is marked in some way with a number indicative of the club number, or the type of club which will be inserted, shaft first, into these openings. These receptacles can be downward depending tubes 18 which are molded intact with the top plate and the circumferential portion 24, that provides a relatively rigid assembly. More detail will be provided of these receptacles and the sensors in connection with FIGS. 3 and 4.

There can be dividers 25 and 27, in any way desired, to make it convenient to find and use the appropriate opening for a given golf club, so that it will always be present in the same spot of the same bag. The electronic package 26, 28 will have a cable 31 with individual conductors to be carried to each of the coils 20 as will be further explained. If there are any specific clubs which are not to be monitored, such as the woods, for example, the construction indicated for the nine tubes shown in FIG. 1 would not be required. Of course, dummy tubes could be used just to provide symmetry or to make it more convenient to hold the clubs. However, the tubular construction would be very important for those clubs which are to be sensed and form a basis for augmenting or activating an alarm, and so on.

Figure 3:
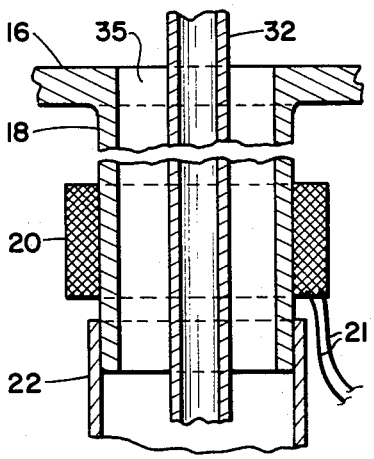
FIG. 3 illustrates in greater detail the types of sensor involved.

Referring now to FIG. 3 there is shown portions of the tubular receptacles 18, 22. The upper portion 18 would be preferably molded of suitable plastic material as to be part of the cover plate 16 of the assembly. The coils could then be simply slipped over these short stub tubes and cemented in place, for example. The lower portions 22 which are long cylindrical receptacles would be long enough so that the shafts of the clubs could be entirely inserted into the receptacles 18 and into the depending receptacles or bags 22. The lower portion 22 can also be molded, but it can be applied to the short stubs 18 by any method desired, such as by cementing, for example. The portion 22 can be rigid or made of a flexible fabric, etc.

Figure 6:
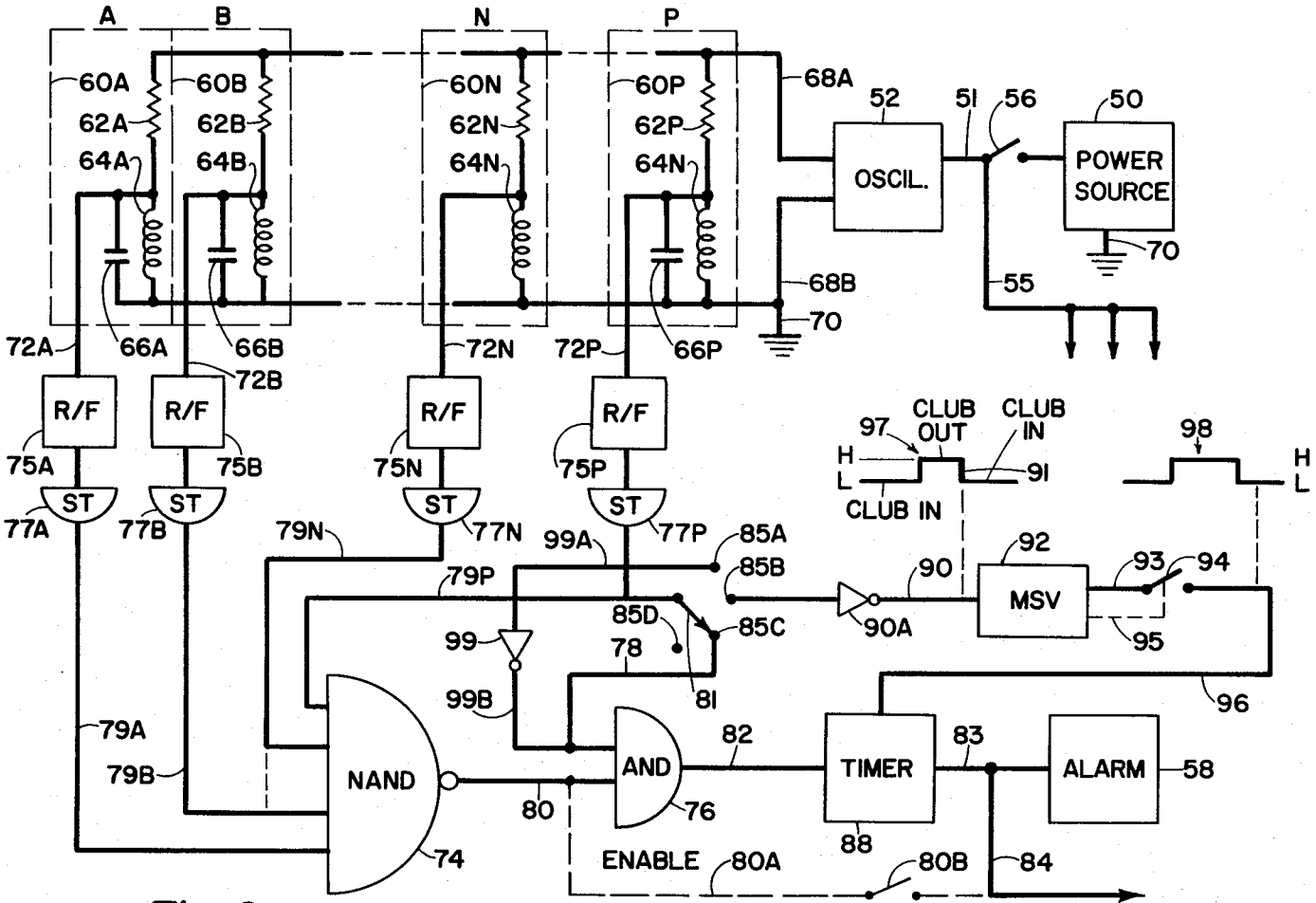
FIG. 6 illustrates one embodiment of a control circuit that would be used to monitor the presence of golf clubs in a golf bag.

The arrangement of length of the receptacle and so on would be such that with the club head resting on the top surface 16 there will be a clear portion of the metallic shaft, the ferrous material of which is to be sensed by the electronic circuitry shown in FIGS. 3 and 6. If there are woods they can be handled and monitored in the precisely same way that the irons are monitored. The putter will be described separately from the irons in that it is always the last club that is played on any hole. When it is finally placed into the bag, all the others should be already in the bag and by proper programming of the micro-processor, the logic can be selected so that the monitoring will take place responsive to the final insertion of the putter into its opening in the assembly of the apparatus 10.

Figure 5:
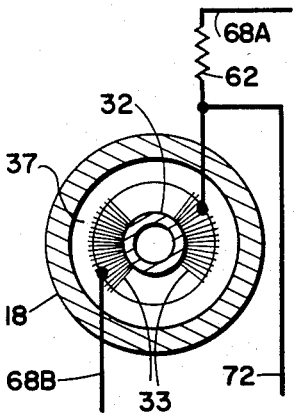
FIG. 5 illustrates schematically a conductivity detector, or switch type sensor which can be used in place of the induction sensor of FIG. 3.

Referring to FIG. 5 there is shown another embodiment of sensor for detecting the presence of a club in a receptacle. This sensor 37 comprises a pair of spring wire brushes 33 of brass or bronze, for example, attached to the inside of the tube 18. These spring wire brushes will press on and make contact with the metal shaft 32 of the club and can be used in a circuit like FIG. 6 to monitor the presence of the club. Of course, other types of enclosed switches, or open contact can be utilized, as desired.

Figure 4:
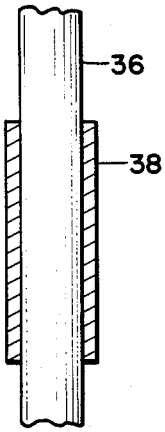
FIG. 4 illustrates how a nonferrous shaft of a golf club can be converted to one that would activate the induction coil of this invention.

As shown in FIG. 4, if the shaft 36 of any club is not of ferrous material, it can be made to control the signal in the coils 21 by either wrapping the appropriate portion of the shaft with thin films 38 of proper magnetic material, or the magnetic material can be magnetic particles held in a thick or viscous paint that can be painted on the shaft in a sufficiently thick layer 38 to provide the magnetic effects necessary to operate the sensor.

Referring now to FIG. 6 there is shown one embodiment of an electronic apparatus which can be used to monitor the golf bag. In conjunction with suitable logic programming, it can activate an alarm when certain conditions occur relative to the position of all the monitored clubs in the bag.

The apparatus of FIG. 6 would be installed in a container or box, such as the electronic package 26/28, which is a container insertable into the molded top plate of the assembly. There would be a power supply 50, for example, which would be mainly a battery of selected voltages, and a switch 56, which would apply power to an electrical oscillator 52 of suitable selected frequency, and to an alarm 58 of any desired type, and to other areas by leads 55. There are a number of dashed boxes 60A, 60B, . . . 60N, 60P which represent the sensors of each of the golf clubs A, B, . . . N, P which are to be monitored. Again, I have purposely separated the putter since it can be used to enable or disable the alarm under certain logic conditions, as will be discussed later.

The output voltage of the oscillator is applied between line 68A and 68B. Line 68B is shown as grounded at point 70. Connected between line 68A and 68B are a number of series circuits, all of which can be identical if desired, or different if the golf clubs themselves are sufficiently different that it may be desired to detect them and monitor them separately from the remaining clubs. Each of the circuits contains a series resistor, such as 62A, 62B, 62N, 62P in series with an induction coil 64A, 64B, 64N, 64P connected between the lines 68A and 68B.

It may be desirable to partially tune the inductances 64 with a parallel capacitor 66A, so that by tuning the circuit of inductance and capacitance 64, 66, a wider range of electrical impedance can be provided when the club shaft 32 is inside of the coil 64 as compared to when the shaft 32 is out. A range of about ten to one in impedance would be desirable. The coil 64 is the same coil identified by numeral 20 in FIG. 3. In other words, the electrical impedance of the coil 20 as measured between two leads 21 will be different by a ratio 5:1 to 10:1 under the conditions of applied potential of a selected frequency if the shaft of the club is inserted in the coil or is not inserted in the coil. Thus, by detecting an effect of the presence of the shaft in the coil it is possible then to monitor whether the shaft is indeed in the coil or not, that is, whether the club is in the bag or it is not.

There are leads 72A, 72B, 72N, 72P, etc. connected to the junctions between the series resistances 62 and the induction coils 64. These go through rectifiers and filters 75A, 75B . . . 75N, 75P, and then through signal conditioning means 77A, 77B, . . . 77N and 77P, such as Schmitt triggers 77, which are well known in the art and need no further description.

The leads 79A, 79B, 79N, 79P from the Schmitt triggers 77 will each go to an individual input terminal of a multi-terminal NAND gate 74. The action of the NAND gate is, for example, such that if all of the input leads have a high DC potential on them (that is, of the order of five volts as compared to a low voltage of the order of 0.3 volt) then the output potential on lead 80 will be low. On the other hand if any one of the input leads is low then the output voltage will be high. This high voltage could go directly to activate the alarm 58, as shown by the dashed line 80A, switch 80B and line 84. It is well known that a NAND gate is the same as an AND gate plus an inverter. Thus, the operation with an AND gate at 76 would be similar depending on whether the alarm requires a high voltage or low voltage (that is, a "1" or an "0") to be activated.

Any type of alarm can, of course, be used such as a flashing light, or a discontinuous or pulsating tone, and so on.

Shown in FIG. 6 is a logic control with the gate 76 operated by the potential on lead 72P from the putter sensor through the filter 75P and Schmitt trigger 77P, switch 81/85C and line 78. Of course, this is about the simplest type of control that is possible. With the addition of other logic elements which are well known in the art, it is possible to set up a series of selected circuit elements to provide a control responsive to certain inputs in a variety of different ways. This is made convenient by the use of a microprocessor, not shown, but well known in the art.

A lead 84 is shown schematically responsive to the voltage on leads 82, 83 which can be used by means of a relay contact (not shown) to interlock with the engine or motor of the golf cart, so that the cart cannot be started, for example, if the alarm is sounding. In this way, it makes certain to the player that he has left a club somewhere relative to the hole which has just been completed. Of course, this can be disabled also by suitable programming of the microprocessor. This control could be in parallel with the alarm 58, or as a substitute for the alarm.

A preferred embodiment of the alarm system is shown schematically in FIG. 6. This involves the switch 81, with 4 contacts 85A, 85B, 85C and 85D. With the switch 85D, the voltage on lead 72P is then connected through 75P, 77P, 79P. In this condition, the circuit operates in the manner where the output of NAND 74 on line 80 goes directly to the alarm 58 (such as by dashed lead 80A, switch 80B and lead 84.

With switch 81 connected to 85C, then the AND gate 76 acts as an enabling means to enable the alarm 58 whenever the putter is "in the bag". So long as the gate 76 is operative, then voltage on lead 82 goes to the alarm through a timer 88 and lead 83. The timer can be set to turn off the alarm after a selected time interval.

With switch 81 and 85A then the alarm becomes activated when the putter is out of the bag.

Another case illustrates a circuit which will only enable the alarm (even when one or more clubs are missing) until the putter has been withdrawn from the bag, used and has been replaced. The act of replacing the putter in the bag sets the logic to sound the alarm if clubs are missing from the bag. Since the last thing that the players do before they drive away from a hole is to replace the putter (and all clubs should be in the bag), this act then enables the alarm unless all clubs are in the bag.

Consider switch 81 on contact 85B. Then signal from the putter sensor on 72P appears on lead 90, after reversal by inverter 90A, to be "low" when the putter is in the bag. At time 97 the putter is taken out, and the signal goes high. Then at time 91 when the putter is replaced, the voltage goes low, or "goes negative". The integrated circuit 92 is a "negative going" triggered monostable vibrator (MSV). When the voltage drops (as the putter is replaced) the MSV 92 is activated and closes switch 94 by means 95, for a selected period of time, placing a high signal 98 on lead 96. This activates the alarm 58 through the timer 88. After a selected period of time, the MSV 92 reverts to low output and deactivates the alarm if the timer 88 has not yet done so.

In the dashed box N the coil 64N is not shown with a parallel capacitance 66. This indicates that if with a suitable coil 64 a wide enough range of voltage is provided, as between club in and out, then the capacitance would not be needed. It can always be used to tune the inductance to provide a factor of safety.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim, or claims, including the full range of equivalency to which each element thereof is entitled.

What is claimed:

1. Apparatus associated with and attached to a golf club bag for monitoring the presence or absence of at least certain ones of the golf clubs carried in said golf bag, comprising:

(a) an assembly of a plurality of laterally spaced short tubular receptacles each one adapted to receive the shaft of a golf club, said assembly adapted to be supported by the open top of said golf bag;

(b) first means associated with each of said tubular receptacles for sensing when the shaft of a golf club is inserted into the receptacle;

(c) second means for monitoring all of said first means, and activating an alarm when under selected conditions at least one of said clubs other than said putter is not positioned in a tubular receptacle; and wherein said alarm is enabled whenever, the putter having been outside of the bag is reinserted into the bag.

2. The apparatus as in claim 1 and including means to disable the motive power of a golf cart in which said bag is carried when said alarm is activated.

3. The apparatus as in claim 1 in which said first means comprises mechanical contact means.

4. The apparatus as in claim 1 in which said first means comprises electrical switch means.

5. The apparatus as in claim 1 in which said first means comprises electromagnetic means.

6. The apparatus as in claim 5 in which said electromagnetic means is part of a resonating electronic circuit which can selectively output a high or low signal when said club is selectively inside of or outside of said tubular receptacle.

7. The apparatus as in claim 5 in which said electromagnetic means, comprises:

(a) electrical oscillator means providing a voltage of selected frequency;

(b) a plurality of inductive circuits comprising at least an inductance coil in series with a resistor, all connected in parallel across the voltage output of said oscillator means;

(c) each of said inductance coils wound around one of said turbular receptacles; and (d) means to monitor the voltage across each of said inductance coils while the shaft of a club is inserted through one of said coils as compared to when it is outside of said receptacle.

8. The apparatus as in claim 7 and including a capacitor of selected size connected across at least one of said inductance coils.

9. The apparatus as in claim 7 in which said means to monitor comprises a multi-input of the NAND gate or AND types with each input responsive to the electrical voltage across a separate one of said inductance coils.

10. The apparatus as in claim 7 and including means responsive to the voltage across at least one of said inductance coils to enable and/or disable said means to monitor.

11. The apparatus as in claim 1 in which said alarm includes also means to enable and/or disable the motive power of the cart which carries the golf bag which contains the above apparatus.

12. The apparatus as in claim 1 in which at least one of said short tubular receptacles includes also a long tubular bag attached to its bottom end.

13. The apparatus as in claim 1 including timer means in series with said alarm.

14. Apparatus associated with and attached to a golf club bag for monitoring the presence or absence of at least certain ones of the golf clubs carried in said golf bag, comprising:

(a) an assembly of a plurality of laterally spaced short tubular receptacles each one adapted to receive the shaft of a golf club, said assembly adapted to be supported by the open top of said golf bag;

(b) first means associated with each of said tubular receptacles for sensing when the shaft of a golf club is inserted into the receptacle;

(c) second means for monitoring all of said first means, and activating an alarm when under selected conditions at least one of said clubs other than said putter is not positioned in a tubular receptacle; and wherein said alarm is enabled whenever the putter is in its receptacle in the bag.

15. The apparatus as in claim 14 and including means to disable the motive power of a golf cart in which said bag is carried when said alarm is activated.

16. The apparatus as in claim 14 in which said first means comprises mechanical contact means.

17. The apparatus as in claim 14 in which said first means comprises electrical switch means.

18. The apparatus as in claim 14 in which said first means comprises electromagnetic means.

19. The apparatus as in claim 18 in which said electromagnetic means is part of a resonating electronic circuit which can selectively output a high or low signal when said club is selectively inside of or outside of said tubular receptacle.

20. The apparatus as in claim 18 in which said electromagnetic means, comprises:

(a) electrical oscillator means providing a voltage of selected frequency;

(b) a plurality of inductive circuits comprising at least an inductance coil in series with a resistor, all connected in parallel across the voltage output of said oscillator means;

(c) each of said inductance coils wound around one of said tubular receptacles; and (d) means to monitor the voltage across each of said inductance coils while the shaft of a club is inserted through one of said coils as compared to when it is outside of said receptacle.

21. The apparatus as in claim 20 and including a capacitor of selected size connected across at least one of said inductance coils.

22. The apparatus as in claim 20 in which said means to monitor comprises a multi-input of the NAND gate or AND types with each input responsive to the electrical voltage across a separate one of said inductance coils.

23. The apparatus as in claim 20 and including means responsive to the voltage across at least one of said inductance coils to enable and/or disable said means to monitor.

24. The apparatus as in claim 14 in which said alarm includes also means to enable and/or disable the motive power of the cart which carries the golf bag which contains the above apparatus.

25. The apparatus as in claim 14 in which at least one of said short tubular receptacles includes also a long tubular bag attached to its bottom end.

26. The apparatus as in claim 14 including timer means in series with said alarm.

* * * * *